US010271139B2

(12) United States Patent
Gaviot et al.

(10) Patent No.: US 10,271,139 B2
(45) Date of Patent: Apr. 23, 2019

(54) DEVICE AND METHOD FOR FILTERING THE RESONANCE PEAK IN A CIRCUIT FOR SUPPLYING AT LEAST ONE LOUD SPEAKER UPSTREAM OF THE LATTER

(71) Applicants: WHYLOT SAS, Cambes (FR); UNIVERSITE DU MAINE, Le Mans (FR); CNRS, Le Mans (FR)

(72) Inventors: Etienne Gaviot, Le Mans (FR); Mehran Erza, Le Mans (FR); Frederic Polet, Le Mans (FR); Lionel Camberlain, Le Mans (FR); Romain Ravaud, Corn (FR)

( * ) Notice: Subject to any disclaimer, the term of this patent is extended or adjusted under 35 U.S.C. 154(b) by 2 days.

(21) Appl. No.: 15/127,851

(22) PCT Filed: Mar. 3, 2015

(86) PCT No.: PCT/FR2015/000049

§ 371 (c)(1),
(2) Date: Sep. 21, 2016

(87) PCT Pub. No.: WO2015/140421

PCT Pub. Date: Sep. 24, 2015

(65) Prior Publication Data

US 2017/0171660 A1 Jun. 15, 2017

(30) Foreign Application Priority Data

Mar. 5, 2014 (FR) ..... 14 00581

(51) Int. Cl.
*H04R 3/08* (2006.01)

(52) U.S. Cl.
CPC ..... *H04R 3/08* (2013.01)

(58) Field of Classification Search
CPC ..... H04R 3/08
See application file for complete search history.

(56) References Cited

U.S. PATENT DOCUMENTS 6,062,339 A * 5/2000 Hathaway ..... H04R 1/2826 181/156
2005/0039465 A1* 2/2005 Welch ..... F25B 21/04 62/3.7

(Continued)

OTHER PUBLICATIONS

Merilainen, Esa, "Current-Drivign of Loudspeakers-Eliminating major distortion and interference effects by the physically correct operation method", Feb. 8, 2010.*

*Primary Examiner* — Regina N Holder
(74) *Attorney, Agent, or Firm* — Vincent G. LoTempio; Kloss, Stenger & LoTempio; David T. Stephenson

(57) ABSTRACT

The present invention relates to an acoustic signal supply circuit of at least one loudspeaker (HP), this circuit comprising a filtering device of the resonance peak occurring at a given frequency of the supply current, characterized in that the filtering device of the peak is incorporated in a first branch bypassing the intermediate circuit between at least two converters (A, A0), this filtering device being purely electrical in the form of an impedance (Z3) connected, on the one hand, at a point on the intermediate circuit and, on the other hand, to a ground instrumentation, the impedance being called RLC (Z3) for comprising at least one first resistor (R3), at least one first capacitor (C3) and at least one first inductor (L3) arranged in series, the parameters of the first resistor (R3), the first capacitor (C3) and the first inductor (L3) being predetermined as a function of the resonance peak to be filtered.

9 Claims, 3 Drawing Sheets

(56) References Cited

U.S. PATENT DOCUMENTS

Figure 1:
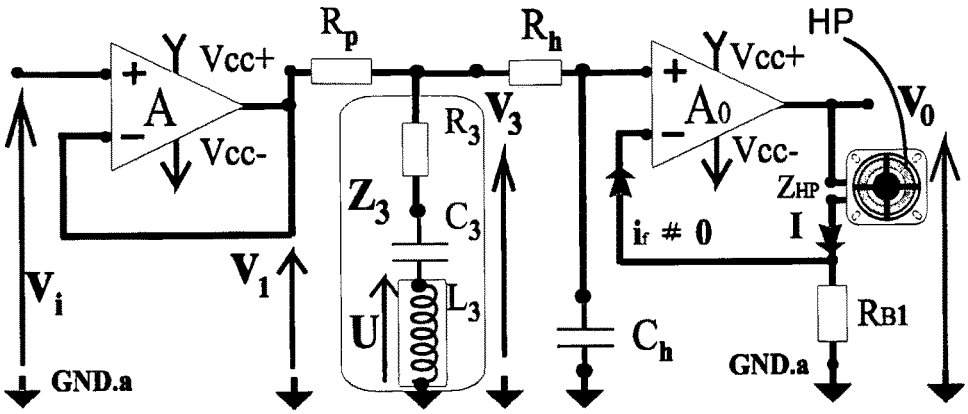

2011/0199801 A1* 8/2011 Grbovic ..... H02P 27/06
363/131
2016/0249131 A1* 8/2016 Oclee-Brown ..... H04R 1/2826

* cited by examiner

DEVICE AND METHOD FOR FILTERING THE RESONANCE PEAK IN A CIRCUIT FOR SUPPLYING AT LEAST ONE LOUD SPEAKER UPSTREAM OF THE LATTER

The present invention relates to a device and a filtering method of the resonance peak in a power supply circuit of at least one loudspeaker, the filtering device being arranged upstream of said at least one loudspeaker.

It is known that a conventional loudspeaker includes an electromagnetic actuator, usually composed of a coil disposed on a movable assembly within a magnetic field generated by a permanent magnet.

When the coil of the loudspeaker is traversed by a frequency-modulated current, the mechanical displacement induced at audio frequency is converted into an acoustic field by means of a membrane acting as the emitting surface, also called acoustic radiator.

The sound quality of the loudspeaker depends on the frequency response curve, i.e. a mechanical acceleration response to an electrical load either or of current or voltage, which is sought to be as constant as possible throughout the entire bandwidth. The sound quality also depends on the linearity of the device characterized by the presence of a minimum of harmonic distortions and intermodulations.

If the transducer acting as loudspeaker promotes all frequencies equally, reproduction of the timbre of a musical instrument, constitutive of useful sound harmonics, appears prima facie to be ensured.

However, the reality is more complex in view of the need to properly reproduce attack transients of representative sounds of the acoustic signature of quality instruments. The response of the loudspeaker to the transients is an essential condition of "fidelity" that can be tested by detecting the "smearing" of the membrane when the loudspeaker is solicited by a pulse train. The inertia of the mobile assembly and the forces due to self-induction phenomena participate in this defect.

Acoustic, optical and electrical measurements show that there is no ideal loudspeaker and that each implementation is flawed in terms of bandwidth limitation, various resonance peaks and inertia. The coupling of several transducers allows in principle to overcome many shortcomings, but, conversely, it sometimes happens that the shortcomings adversely cumulate for a quality musical reproduction.

In a loudspeaker, the useful driving force at the origin of the displacement of the mobile assembly results from the interaction of the magnetic induction field, denoted B, with each element of length of the winding traversed by a current denoted i(t) function of a time t. At the local level, the elemental force applied to a load carrier in displacement within an induction field is called a Lorentz force and is exerted in a direction perpendicular to the plane defined by the scope and speed of the carriers. A record within a load carrier elementary volume subject to the phenomenon leads to the expression:

$$F=i.\int_0^l \vec{B}.d\vec{l}=B.l.i \tag{1}$$

Everything occurs as if the unwound length of the winding, denoted l, was exposed to a homogeneous magnetic induction field, which allows defining the amount Bl=B.l called power factor (in Newton per amp or in Tesla.meter) of the mobile part of the loudspeaker.

This force modulated by the intensity, solicits the mobile assembly whose mechanical behavior is dictated by three components: a force of inertia, product of the mass of the moving parts denoted Mm by the imposed acceleration, a force of damping, generally assumed to be proportional to the displacement speed through a constant denoted $f_m$ in Newton/m/s or kg/s, and a restoring force linked to the mechanical suspension affected by a stiffness denoted $k_m$ in N/m. For a guided translation on an x axis, the behavioral equation of such idealized transducer is:

$$F = B_l \cdot i = M_m \cdot \frac{d^2x}{dt^2} + f_m \cdot \frac{dx}{dt} + k_m x \tag{2}$$

The current-voltage relationship at the terminals of the loudspeaker is governed by its structure characterized by the mobile assembly moving within a magnetic field. Thus, the electrical behavior is dictated by two mechanisms, namely the dissipation by Joule effect related to the Ohm's law and electromagnetic interactions in terms of induced electromotive forces, subtended by three contributions:

- the voltage drop related to the resistive component of the assembly solenoid winding,
- the induced electromotive force related to the variation in magnetic flux during displacement,
- the self-induction electromotive force governed by the law of Lenz.

Thus, assuming system linearity, an electric behavioral equation is added to the aforesaid equation governing the mechanical behavior of the loudspeaker:

$$e_{(t)} = R_e \cdot i_{(t)} + L_e \cdot \frac{di}{dt} + B_l \cdot \frac{dx}{dt} \tag{3}$$

In which $R_e$ is the pure resistive component of the winding, likely to vary with the temperature measured in ohms, and $L_e$ the sound inductor proper, function of the displacement measured in Henry when taking into account the nonlinearities. In fact, if the current involved in the left-hand side of the second equation follows directly from the third equation, then any disruption or non-linearity involved in the latter causes an influence on the displacement of the membrane and its derived functions.

There are two respective strategies for controlling a loudspeaker, namely a current control or a voltage control. If, in both cases, the signal processing by the stages of preamplification leads to a consistently measurable control signal as a voltage, in the case of a voltage control, it is naturally dependent on the impedance of the dipole that the transducer represents when acting as loudspeaker. This control is similar to a bond between Thevenin ideal generators capable of supplying to the loudspeaker. The loudspeaker then constitutes a tributary load of an almost zero impedance power supply and any electromotive force or EMF component generated directly influences the current flowing through the association.

Conversely, for a current control, the current-voltage transduction is provided by a specifically designed signal conditioner, the transducer being solicited by the output current of this conditioner. This control is similar to a Norton ideal generator capable of supplying to the transducer: the latter represents then a load solicited under infinite impedance on which any EMF fluctuation generated by the load remains without consequences on the behavior of the association. Better yet, this voltage can be measured then used as correction signal in a servoing strategy.

Generally, control by voltage directly solicits loudspeakers given an electrical behavior subjected to the constituent parameters of its impedance. It is only relatively recently that various works were conducted for the design of loudspeakers specifically electrically controlled, given adequate conditioners.

Among electrical and mechanical parameters representative of the behavior of a loudspeaker, the three magnitudes, Bl, $R_e$, $L_e$ aforementioned fundamentally determine the quality of reproduction of the conditioner-transducer association. Interactions will not be the same depending on the choice made by the designer between the two control modes in current and voltage.

With a current control, the conditioner-transducer association remains by nature totally immune to the tensions generated. For such a choice, however, it is necessary to detect and correct, if possible, the defects inherent in the alteration of the parameters involved in equation (2) which in fact presents a force of parasite-term function of the intensity squared or $i^2$ called solenoid according to the formula:

$$B_l \cdot i + \frac{1}{2} \cdot i^2 \cdot \frac{dL_e}{dx} = M_m \cdot \frac{d^2x}{dt^2} + f_m \cdot \frac{dx}{dt} + k_m \cdot x \tag{4}$$

Equation (2) can be written in the frequency domain by:

$$B_l \cdot I = M_m \cdot p^2 \cdot X + f_m \cdot p \cdot X + k_m \cdot X = M_m \cdot \left[p^2 + \frac{f_m}{M_m} \cdot p + \frac{k_m}{M_m}\right] \cdot X \tag{5}$$

where X is the transform of the displacement according to Laplace and I is 1 times the unit, the $f_m$:$M_m$ ratio being representative of the attenuation which is the reverse function of the relaxation time, while $k_m/M_m$ translates the square of the resonance angular frequency.

By denoting $f_m/M_m=2/\tau$ and $k_m/M_m=\omega_0^2$, $w_0$ being the initial angular speed, the transfer function of the displacement applied to the current is expressed:

$$\frac{X}{I} = \frac{B_l}{M_m} \cdot \frac{1}{\left(p^2 + \frac{2}{\tau} \cdot p + \omega_0^2\right)} = \frac{B_l}{M_m} \cdot \frac{1}{(p-a)\cdot(p-b)} = \frac{B_l}{M_m} \cdot \frac{1}{P_1} \tag{6}$$

Equations (2) and (3) may be considered in the frequency domain in harmonic regime and combined therebetween in terms of the cascaded transfer functions. By denoting $E_0$ and $I_0$ the decoupled complex magnitudes of their evolutionary part, the index being indicative of a particular angular frequency also called "phasors", we obtain:

$$E_0 = I_0 \cdot (R_e + L_e \cdot p) + B_l \cdot (X \cdot p)$$

$$B_l \cdot I_0 = M_m \cdot p \cdot (p \cdot X) + f_m \cdot (p \cdot X) + \frac{k_m}{p} \cdot (p \cdot X) \; soit \; (p \cdot X) = B_l \cdot I_0 / \left[M_m \cdot p + f_m + \frac{k_m}{p}\right]$$

After substituting product p.X in the first relationship, the impedance transfer function appears immediately in a composite form involving two terms:

$$\frac{E_0}{I_0} = Z_{HP} = (R_e + L_e \cdot p) + \frac{B_l^2}{M_m} \cdot \frac{p}{\left(p^2 + \frac{f_m}{M_m} \cdot p + \frac{k_m}{M_m}\right)} \tag{7}$$

If the reactance component is neglected, then the impedance of the loud loudspeaker can be written:

$$Z_{HP} \approx R_e + \frac{B_l^2}{M_m} \cdot \frac{p}{P_1} = \frac{R_e \cdot M_m \cdot P_1 + B_l^2 \cdot p}{M_m \cdot P_1} \tag{7a}$$

Grouping the parameters then leads to the following simple form:

$$\left[\frac{X}{E}\right]_p = \frac{B_l}{M_m \cdot R_e} \cdot \frac{1}{\left[p^2 + \left(\frac{f_m + B_l^2/R_e}{M_m}\right) \cdot p + \omega_0^2\right]} = \frac{B_l}{M_m \cdot R_e} \cdot \frac{1}{V_1} \tag{7b}$$

It is immediately apparent that the polynomial $V_1$ which is the one representative of the voltage control-related behavior is characterized by a damping a fortiori greater than that of the polynomial $P_1$ associated with the current control regime. To the viscous friction coefficient $f_m$ of a current control regime is substituted, for a voltage control regime, a systematically increased coefficient such as:

$$f_{m+e}=(f_m+B_1^2/R_e)>f_m \tag{8}$$

With regard to the times proper respectively involved ($\tau_m$ and $\tau_{m+e}$), mechanical resonance factor $Q_m$ and $Q_{m+e}$, are defined as:

$$Q_m = \frac{\omega_0 \cdot \tau_m}{2} = \frac{\sqrt{k_m \cdot M_m}}{f_m} \text{ and } \quad Q_{m+e} = \frac{\omega_0 \cdot \tau_{m+e}}{2} = \frac{\sqrt{k_m \cdot M_m}}{f_m + B_l^2/R_e} \tag{9 and 9a}$$

A specifically electric coefficient $Q_e$ can thus be defined by letting $f_m$ tend towards zero and a simple relationship coupling the resonance factors can then be written:

$$\frac{1}{Q_{m+e}} = \frac{1}{Q_m} + \frac{1}{Q_e} \tag{10}$$

The impedance of the transducer combines an exclusively electric component with a second component called motional impedance. Thus, the loudspeaker impedance $Z_{HP}$ is written $Z_{HP}=Z_e+Z_m$ with:

$$Z_e = (R_e + L_e \cdot p), \quad \text{et } Z_m = \frac{B_l^2}{M_m} \cdot \frac{p}{\left(p^2 + \frac{f_m}{M_m} \cdot p + \frac{k_m}{M_m}\right)} = \frac{B_l^2}{M_m} \cdot \frac{p}{P_1} \tag{11, 11a}$$

It appears that the motional impedance is affected by a characteristic polynomial of order two showing a band-pass type behavior. In addition, if it is customary to designate the nominal impedance value by a given value, often 4 W and 8 W often for power transducers, 16 W and 32 W for mini and microsystems equipping helmets, the contribution of the motional impedance is by no means negligible when the transducer must be applied voltage. Similarly, when the frequency increases, the inductive reactance component j.L.w progressively attenuates the reproduction of signals.

The behavior of a transducer when applied voltage shows the coupling of relationships 8 and 9*b* associated in terms of composite transfer functions. Considering here the relative displacement function X(p), resuming the previous notation of equation (6):

$$\left[\frac{X}{I}\right]_p = \frac{B_l}{M_m} \cdot \frac{1}{P_1} \text{ avec } P_1 = \left(p^2 + \frac{2}{\tau} \cdot p + \omega_0^2\right)$$

Equation (11) descriptive of the impedance of the transducer results in addition:

$$\left[\frac{X}{E}\right]_p = \left[\frac{X}{I}\right]_p \cdot \left[\frac{I}{E}\right]_p = \frac{B_l}{M_m} \cdot \frac{1}{P_1} \cdot \frac{1}{Z_{HP}} \tag{12}$$

As a result, the transfer functions of the speed of the diaphragm and the acceleration, in terms of derived magnitudes, are then expressed in two equations:

$$\left[\frac{V}{E}\right]_p = \frac{B_l}{M_m} \cdot \frac{p}{P_1} \cdot \frac{1}{Z_{HP}} \text{ et } \left[\frac{A}{E}\right]_p = \frac{B_l}{M_m} \cdot \frac{p^2}{P_1} \cdot \frac{1}{Z_{HP}} \tag{12 \& 12a}$$

If we consider the function related to the displacement, it can be expressed generally as follows:

$$\left[\frac{X}{E}\right]_p = \frac{B_l}{M_m} \cdot \frac{1}{P_1} \cdot \frac{1}{Z_{HP}} = \frac{B_l}{M_m} \cdot \frac{1}{P_1} \cdot \frac{1}{(R_e + L_e \cdot p) + \frac{B_l^2}{M_m} \cdot \frac{p}{P_1}} \tag{13}$$

An important consequence of this writing appears immediately, when looking at close regimes of resonance, with the need for a correction by filtering in the case of current control. The voltage control allows for its part to enjoy a significant advantage, often cited as the definitive argument justifying that choice, with a natural damping effect much greater than for current control.

Document FR-A-2 422 309 acknowledges in its introduction that for a loudspeaker controlled by current the membrane of the loudspeaker can be the seat of deformations or standing waves at very high frequency, which is particularly disadvantageous for a current control. Conversely, this document recognizes that a voltage control is only usable in a restricted frequency range.

To improve the current control, this document proposes to combine a current control and servo acceleration for the frequency range covering all mechanical resonances of the loudspeaker. However, this solution has never been satisfactory because servo acceleration has not been able to compensate all mechanical resonances specific to each loudspeaker.

Document GB-A-2 473 921 discloses in its introduction that the sound quality of electrodynamic loudspeakers can be significantly improved by supplying a loudspeaker with a current control instead of the voltage control frequently adopted. The current control is obtained when the source impedance seen by the driver is high compared to the impedance of the driver itself.

This document also recognizes that, in current control, a typical peak frequency of an uprising of a loudspeaker in the shape of a cone cannot be compensated by simply adding an RC network in parallel with the driver, the high impedance of the source being then lost.

This document therefore provides a control of the loudspeaker with a double coil used in conjunction with an impedance which disables one of the voice coils at high frequencies, producing the correction of the required response while retaining a relatively high impedance of the source.

The addition of a dual coil, however, requires a complete reconstruction of the control coil in current which is not usually twofold. This presents a cost prohibitive and design specific arrangements for the current control.

Esa Meriläinen's document titled "Current-driving of loudspeakers—Eliminating major distortion and interference effects by the physically correct operation method" dated Feb. 8, 2010, USA, ISBN: 1450544002 represents the closest state of the art. This document discloses an acoustic signal supply circuit of at least one loudspeaker incorporating a filtering device of the resonance peak of said at least one loudspeaker occurring at a given frequency of the supply current of said at least one loudspeaker, said circuit comprising at least a non-inverting converter arranged upstream of said at least one loudspeaker having a positive supply terminal connected to the circuit input supply and a negative supply terminal, said circuit also comprising at the output of said at least one loudspeaker a first instrumentation ground circuit bypassing a feedback loop connecting a point in the circuit downstream of the loudspeaker to the negative supply terminal of the non-inverting converter, the filtering device of the resonance peak of the at least one loudspeaker being purely electrical as an impedance embedded either in the first instrumentation ground circuit or in the feedback loop, the parameters of the impedance being predetermined as a function of the resonance peak to be filtered for said at least one loudspeaker.

According to the two documents from the state of the aforementioned technique, while the advantages of a current control of a loudspeaker have been recognized, to date no solutions to remedy effectively two endemic major disadvantages of such current control have been developed, namely:

- firstly, the presence of a resonance peak that cannot remain without being corrected, while a voltage control brings precisely a natural correction to this resonance peak thanks to the effects of the motional impedance keyed to the transducer resonant frequency,
- secondly, as the frequency increases, the acoustic studies show an increased directional effect of the loudspeaker leading to a measurable enhancement of the sound level in the axis perpendicular to the diaphragm, this phenomenon being called "horn effect". Again, when using voltage control, the inductive component of the transducer corrects this effect locally before reducing the sound level in the higher frequencies.

The object of the present invention is, for any loudspeaker category, to correct at least the presence of a resonance peak when using current control on a loudspeaker, by electronic means and without any specific adaptation of the current control of the loudspeaker, which remains unchanged from that of the prior art.

To this end, the invention relates to an acoustic signal supply circuit of at least one loudspeaker, said circuit comprising a filtering device of the resonance peak occurring at a given frequency of the supply current of said at least one loudspeaker and at least two non-inverting converters arranged in series upstream of said at least one loudspeaker, each of the two converters having a positive supply terminal and a negative supply terminal and an output, the more upstream of the two converters having its positive supply terminal connected to the supply input of the circuit while its output is connected via an intermediate circuit to the positive supply terminal of the second converter, the output of the second converter being connected to said at least one loudspeaker, characterized in that the filtering device of the resonance peak of said at least one loudspeaker is incorporated in a first branch bypassing the intermediate circuit between said at least two converters, this filtering device being purely electrical in the form of an impedance connected on the one hand, to a point of the intermediate circuit and, on the other hand, to a mass of instrumentation, said impedance being called RLC when comprising at least one first resistor, at least one first capacitor and at least one first inductor arranged in series, the parameters of the first resistor, the first capacitor and the first inductor being predetermined as a function of the resonance peak to be filtered of said at least one loudspeaker.

The technical effect is to be able to use a current control with the advantages mentioned above while hiding at least the major disadvantage of a current control which is the formation of a resonance peak not compensated by this current control, unlike what occurs with a voltage control.

A virtual inductor is particularly advantageous since it can be easily modified without changing the components that make it up but only in their interaction and/or operation. Such virtual inductor has the great advantage of an easy adaptation to operating conditions of said at least one speaker, including but not limited to for monitoring a variation in the frequency of the resonant peak due for example to a change temperature of the at least one loudspeaker or against overheating of the at least one loudspeaker.

Advantageously, the first virtual inductor is equal to the product of the first and second auxiliary resistors and the auxiliary capacitor.

Advantageously, the first resistor and the second auxiliary resistor are deducted from each other in a total resistance according to the equation:

$$R_3=R_{03}-R_A$$

Advantageously, a second capacitor is arranged in a second branch bypassing the intermediate circuit between said at least two converters, said second capacitor being associated with a second resistor, the parameters of the second resistor and the second capacitor being predetermined to reduce the high frequency signals.

Advantageously, the intermediate circuit between the two non-inverting converters comprises a third resistor arranged between the output of the most upstream non-inverting converter and the first branch bypassing the intermediate circuit incorporating the filtering device.

Advantageously, for a 197 Hz resonance peak frequency, the value of said at least one first resistor is equal to 0, the values of said at least one first capacitor and said at least one first inductor are respectively equal to 0.29 μF and 2.28 H, the values of the first auxiliary resistor and the second auxiliary resistor being respectively equal to 1,200Ω and 400Ω, the value of the third resistor being equal to 3,000Ω.

Advantageously, each non-inverting converter has its own feedback loop connecting its output to its negative supply terminal, each of the feedback loops being mounted, for the most upstream converter, by bypassing the intermediate circuit between the two non-inverting converters and, for the most downstream converter, by bypassing an instrumentation ground circuit arranged after said at least one loudspeaker, the instrumentation ground circuit comprising a fourth resistor.

The invention also relates a method for controlling the supply of the electrical power into acoustic signals of at least one loudspeaker, the power supply incorporating such a filtering device of the resonance peak, in which method a correction step of the resonance peak by the filtering device is carried out, said correction step being carried out upstream of said at least one loudspeaker.

Advantageously, the overall resonance factor of the loudspeaker and the filtering device is set to a Butterworth filter.

Advantageously, when said at least one loudspeaker comprises a diaphragm, filtering the resonance peak to a reduction in the sound level in the higher frequency in the direction of the axis perpendicular to the diaphragm of said at least one loudspeaker is carried out simultaneously.

Advantageously, the temperature variations of said at least one loudspeaker are taken into account by the filtering device by variation in correspondence of the parameters of the impedance of said device.

A current control does not regulate possible overheating of said at least one loudspeaker unlike a voltage control. This can be a disadvantage in addition to the two aforementioned disadvantages, namely the formation of an uncompensated resonance peak and the increase of sound level in the highest frequencies in the direction of the axis perpendicular to said diaphragm of said at least one loudspeaker. In addition, the frequency of the resonance peak may vary with a temperature change of the loudspeaker. Therefore, the temperature changes of said at least one loudspeaker should preferably be taken into account especially during the correction of the resonance peak.

All this can be compensated by changing the parameters of the impedance of the filtering device, in particular the inductor which may be a virtual inductor. In this case, taking into account the temperature of said at least one loudspeaker, which can be either measured or estimated, is performed automatically through respective modification of the various elements that make up the virtual inductor, for example, but not limited to, the auxiliary converters.

Figure 2:
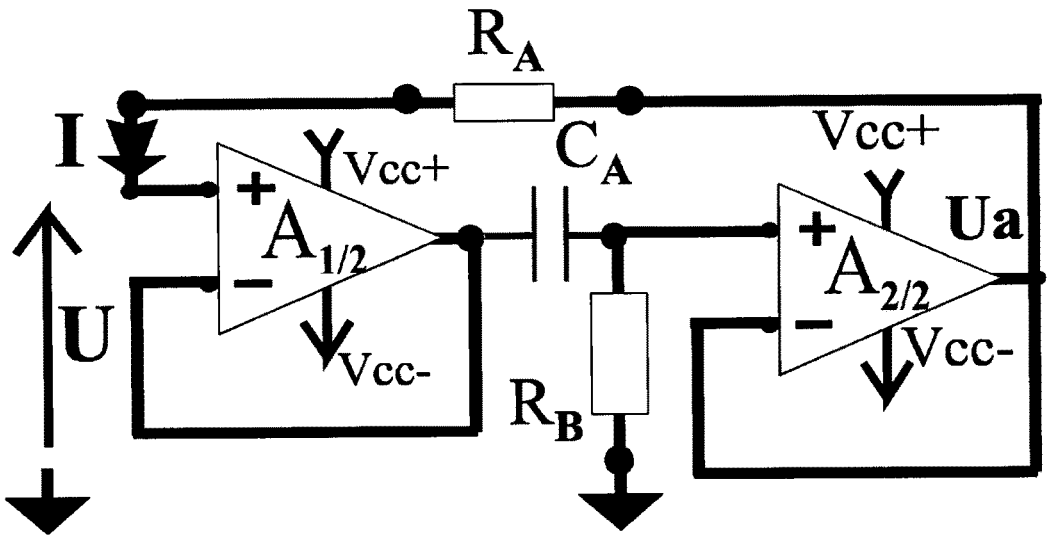
Figure 3:
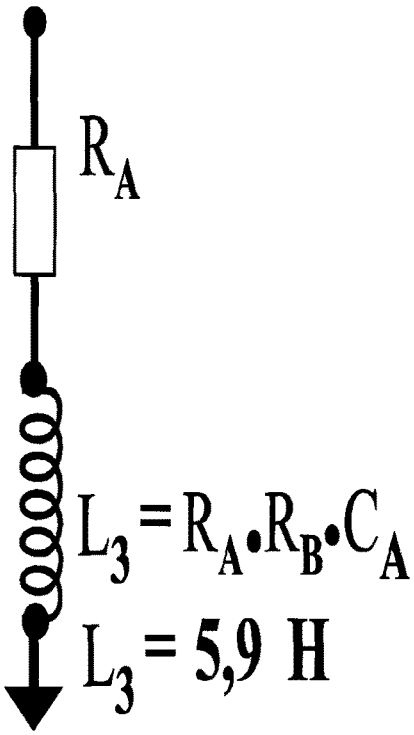
Figure 4:
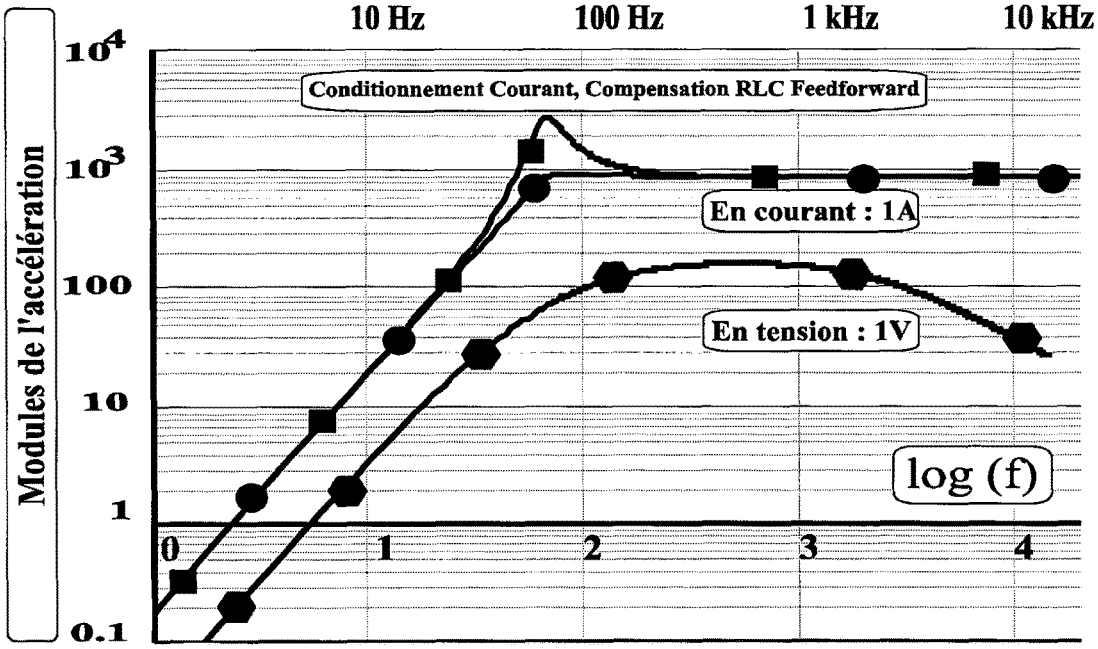
Figure 5:
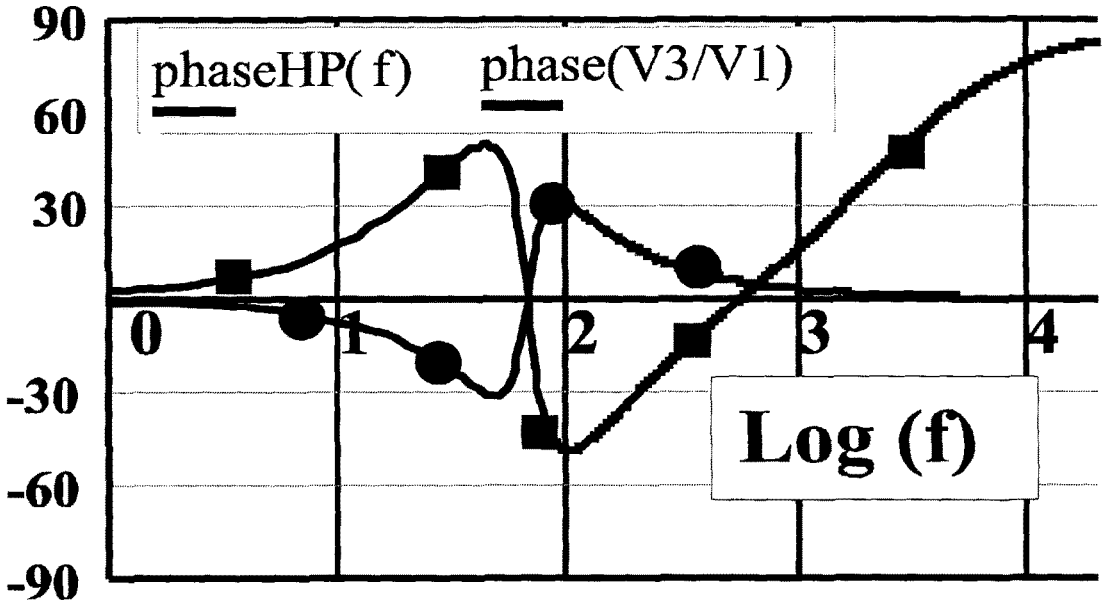

Other advantages and features of the invention will appear upon reading the detailed description of implementations and embodiments, in no way limiting, and the following accompanying drawings:

FIG. 1 illustrates a schematic representation of an acoustic signal supply circuit of at least one loudspeaker, said circuit being provided with a filtering device of the resonance peak according to a first embodiment of the present invention, FIG. 2 illustrates an embodiment of the filtering device of the acoustic signal supply circuit shown in FIG. 1, for which the inductor of the filtering device is in the form of a virtual inductor, the virtual inductor being shown enlarged in this figure with respect to FIG. 1, FIG. 3 shows, for the embodiment shown in FIG. 2, the impedance comprising a virtual inductor, FIG. 4 shows the acceleration modules during a current control respectively with or without filter of the resonance peak as well as during a voltage control of a loudspeaker, the filtering being performed with a filtering device according to the first embodiment of the invention, FIG. 5 shows angle degree curves as a function of frequencies, the filtering being performed with a filtering device according to the first embodiment of the invention shown in FIG. 1.

According to the present invention, an ideal current control solution would be to find a filtering method to filter the two effects mentioned above, namely the resonance peak and the loudspeaker directivity effect without altering the current control index also known as CDI. However, it is possible to filter only the resonance peak of the invention while retaining the optimal current control index.

This rules out any filter structure disposed in parallel with the speaker due to the finite impedance character, even of low value in terms of source according to Thevenin, likely to alter the CDI index in an unacceptable manner on a useful part of the spectrum.

As the correction of the resonance peak falls within the intrinsic behavior of the transducer, the present invention provides a passive solution in an upstream correction of the at least one loudspeaker.

Therefore, the invention relates to a control method in current of the acoustic signal current supply of at least one loudspeaker, the power supply incorporating a filtering device of the resonance peak, in which method a correction step of the resonance peak is performed by the filtering device, this step taking place upstream of said at least one loudspeaker.

The inherent advantage of the correction mode upstream of the loudspeaker or correction a priori, also called "feed-forward correction", is to guarantee the non alteration of the control index in current or CDI in relation to the control of the loudspeaker.

Advantageously, when said at least one loudspeaker includes a diaphragm, filtering of the resonance peak is performed simultaneously to a reduction in the sound level at the highest frequencies in the direction of the perpendicular axis of the diaphragm of said at least one loudspeaker. In the embodiment of the acoustic signal supply circuit, this reduction is provided by a connected resistor and capacitor system bypassing the main circuit as will be further developed.

Advantageously, the overall resonance factor of the speaker and the filtering device takes the value of a Butterworth filter, which will also be further developed.

According to the present invention and referring more particularly to FIGS. 1 to 3, the acoustic signal supply circuit of at least one loudspeaker HP according to the present invention has a filtering device of the resonance peak. The circuit also comprises at least two non-inverting converters, A, A0 arranged in series upstream of said at least one loudspeaker HP, each of the two converters A, A0 having a positive supply terminal and a negative supply terminal as well as an output.

The most upstream A of the two converters A, A0 has its positive supply terminal connected to the circuit input supply while its output is connected via an intermediate circuit to the positive supply terminal of the second converter A0. The output of the second converter A0 is connected to said at least one loudspeaker HP, a resonance peak occurring at a given frequency of the supply current of the at least one loudspeaker HP.

The essential feature of the circuit is that the filtering device of the resonance peak of said at least one loudspeaker HP is incorporated into a first branch bypassing the intermediate circuit between said at least two converters A, A0. This filtering device is purely electrical and is in the form of an impedance Z3 connected, on the one hand, to a point in the intermediate circuit and, on the other hand, to a ground instrumentation. The impedance Z3 is called RLC when comprising at least one first resistor R3, at least one first capacitor C3 and at least one first inductor L3 arranged in series. The parameters of the first resistor R3, the first capacitor C3 and the first inductor L3 are predetermined based on the resonance peak to be filtered of said at least one loudspeaker HP.

Advantageously, the first inductor L3 is virtual, that is to say, the first inductor L3 may for example be formed of a system of active circuits acting as an inductor. Such proposed correction is predefined in the first order and a filtering solution upstream of said at least one loudspeaker HP, also known as "feedforward correction", can thus be developed with medium-power components, the currents remaining below 50 mA, replacing the inductance by the system of active circuits.

For the embodiment using a virtual inductor, the fundamental advantage of the arrangement of the filtering upstream of the voltage current converter appears in the low-intensity values involved in the filtering operation, thus allowing the use of many references components of operational amplifiers with very low noise to constitute the virtual inductance. Effective filtering devices with low noise and without copper coil can thus be developed.

Ultimately, this embodiment with a virtual inductance can allow self-adjusting the filtering device during operation to correct any drift linked to a possible change in the environment of the loudspeaker HP. This can result in particular in an automatic compensation of the shift of the resonance frequency due to the heating of the loudspeaker HP. Then, the process is part of a coupling in thermal feedback loop with the electrical control upstream of the filtering device.

Advantageously, the active circuit system is formed by two auxiliary non-inverting converters $A_{1/2}$, $A_{2/2}$ arranged in series. Each of the two auxiliary converters $A_{1/2}$, $A_{2/2}$ has a positive supply terminal and a negative supply terminal and an output.

The most upstream $A_{1/2}$, of the two auxiliary converters $A_{1/2}$, $A_{2/2}$ has its positive supply terminal connected to the output of the first capacitor C3 while the output of this most upstream auxiliary converter $A_{1/2}$ is connected by a first auxiliary intermediate circuit to the positive supply terminal of the second auxiliary converter $A_{2/2}$.

The first intermediate auxiliary circuit includes an auxiliary capacitor CA and is connected in bypass to an auxiliary instrumentation ground circuit including a first auxiliary resistor $R_B$. The output of the second auxiliary converter $A_{2/2}$ is connected to the first auxiliary converter $A_{1/2}$ by a second auxiliary circuit comprising a second auxiliary resistor RA, each auxiliary converter $A_{1/2}$, $A_{2/2}$ having its own feedback loop connecting its output to its negative supply terminal.

Advantageously, for the impedance Z3 elements they satisfy a compromise between a minimum noise and currents maintained at low values, for example a current intensity in the impedance Z3 less than 5 mA.

The first virtual inductor L3 may advantageously be equal to the product of the first RA and second RB auxiliary resistors and of the auxiliary capacitor CA.

In one preferred embodiment, a second capacitor Ch may be disposed in a second branch bypassing the intermediate circuit between said at least two converters A, A0. This second capacitor Ch is associated with a second resistor Rh, the parameters of the second resistor Rh and the second capacitor Ch being predetermined to reduce the high-frequency signals with a proper effective time Rp.Ch. The second resistor Rh and the capacity of the second capacitor Ch may be respectively $R_h \approx 1\Omega$ et $C_h \approx 4.7$ nF. However, this is only indicative.

The current control is known for not causing high frequency mitigation, unlike the voltage control where the inductive component of the loudspeaker naturally decreases the signal level. It is therefore appropriate to expect in current control a forced mitigation in high frequency, especially with regard to the increased directivity effect of the loudspeaker which leads to an increase in sound level measurable in the axis perpendicular to the diaphragm.

Advantageously, the intermediate circuit between the two non-inverting converters A, A0 includes a third resistor $R_p$ disposed between the output of the most upstream non-inverting converter and the first bypass branch of the intermediate circuit incorporating the filtering device.

Advantageously, each non-inverting converter A, A0 has its own feedback loop connecting its output to its negative supply terminal, each of the feedback loops being mounted, for the most upstream converter A, bypassing the intermediate circuit between the two non-inverting converters A, A0, and for the most downstream converter A0, bypassing an instrumentation ground circuit arranged downstream of the loudspeaker HP, the instrumentation ground circuit comprising a fourth resistor RB1.

V1 and V3 being the voltages as indicated in FIG. 1, V3 being the voltage between the bypass point of the first branch of the filtering device of the resonance peak bypassing the intermediate circuit and a ground instrumentation and V1 being the voltage between the output of the first upstream auxiliary converter A and a ground instrumentation, a conventional calculation allows obtaining the transfer function of $V_3/V_1$ of the filter constituted by the arrangement in series of Rp and the $R_3L_3C_3$ series network as follows:

$$\frac{V_3}{V_1} = \frac{p^2 + (R_3/L_3)\cdot p + 1/L_3\cdot C_3}{p^2 + \frac{R_3 + R_p}{L_3}\cdot p + 1/L_3\cdot C_3}$$

Thus, the filtering effected, possibly combined with the high frequency mitigation by the filter Rh, Ch allows to keep only the function of voltage current conditioner assigned to the power amplifier and supplying the at least one loudspeaker HP. The specificity of this configuration lays in the virtual constitution of the inductor L3 using two active components. In fact, considering the impedance of the assembly RA, RB, CA, A, A0, the following two relationships can be combined:

$$\left[\frac{U_a}{U}\right]_p = \frac{R_B}{R_B + \frac{1}{j\cdot C_A\cdot\omega}} \text{ et } I = \frac{U - U_a}{R_A} \qquad (14 \,\&\, 14a)$$

The identification of the elements then results in an impedance behavior such as:

$$Z_{Eq_self} = \left[\frac{U}{I}\right]_p = R_A + j\cdot\omega\cdot C_A\cdot R_A\cdot R_B \qquad (15)$$

The set thus behaves like an inductor or choke with a value $L_3 = R_A.R_B.C_A$, being put in series with the resistor RA. It is possible to establish a relationship giving R3 according to RA with $R_3 = R_{03} - R_A$. The arrangement of selected parameters allows not having to mount this component, the RA series value having almost the value required to ensure the desired mitigation, 1/Qm, as mentioned in equations (9) and (10). Indeed, if:

$$\frac{1}{Q_m} = \frac{R_A}{R_A + R_p} \text{ alors, } R_A = \frac{R_p}{Q_m - 1} \qquad (16)$$

Advantageously, an overall resonance factor can be defined by taking as the optimum value, that of a filter according to Butterworth, which corresponds to $Q_{HP+Z3} = 1/\sqrt{2}$.

Starting from the above equations, the selection of the following parameter values can be performed:

$$Q_3 = \frac{1}{R_3 + R_p}\cdot\sqrt{\frac{L_3}{C_3}} = 0.856$$

$$\omega_B = \frac{1}{\sqrt{L_3\cdot C_3}} = 416 \text{ rad/sec}$$

FIG. 4 shows the curves of the acceleration modules for a current control with or without filtering the resonance peak as well as the acceleration module for a control voltage of said at least one loudspeaker, filtering being performed with a filtering device according to the embodiment of the invention illustrated in FIGS. 1 to 3.

The unfiltered current control curve is the one with rectangles, the current control curve with filtering is the one with circles and the voltage control curve is the one with diamonds.

The intermediate curve with the rectangles is the curve with current control and filtering with a filtering device according to the first embodiment and shows the absence of a resonance peak unlike the upper curve with current control without filtering. In addition, this intermediate curve has a substantially constant acceleration module range, wider than that of the lower curve which is the voltage control curve with diamonds.

It turns out that the acceleration module with a resonance peak and filtered has a satisfactory behavior if we consider as not penalizing the addition of two active circuits with two auxiliary converters for obtaining a virtual inductor a value close to L3=6 H.

It turns out that the acceleration module with a resonance peak thus filtered has a satisfactory behavior if we consider as not penalizing the addition of two active circuits with two auxiliary converters for obtaining a virtual inductor with a value close to L3=6 H.

FIG. 5 shows the degrees of angle curves depending on the frequencies, the filtering being performed with a filtering device according to the embodiment of the invention shown in FIGS. 1 to 3, which is for the loudspeaker phase or HP defined by the curve with rectangles and for the phase $V_3N_1$ defined by the curve with circles.

The curves in FIG. 5 show that the phase shift angle remains within a range of perfectly permissible values on the considered frequency domain.

In a preferred embodiment of the present invention, moderate values assigned to the capacities, of the order of microfarads, allow the implementation of MKP capacitors in polypropylene, capacitors that are well suited to transients.

A non-limiting example will now be given for a loudspeaker with the following characteristics: Bl=2.675 Tm, Mm=3.67 g, fm=0.539 N/m, km=5650 N/m, resonance frequency=197 Hz, Re=3.65□, L=0.12 mH.

For such a loudspeaker, the following values can be selected for the various circuit elements according to the present invention, $R_3$=0Ω, $C_3$=0.29 μF, $R_p$=3 kΩ, et $L_3$ actively reproduced with $R_A$=400Ω), $R_B$=1200Ω, $C_A$=4.7 μF, or $L_3$ equivalent to 2.28 H.

In what has been described above, at least one non-inverting converter was used in the circuit to simplify the calculations. This is not limitative and the present invention can however also be applied to a circuit comprising several non-inverting converters as well as one or several inverting converters.

The market for audio reproduction, especially high-end reproduction, is directly concerned by filtering devices according to the present invention. The big brands, such as Bose®, Bang & Olufsen®, Harman Kardon®, B&W®, etc . . . should certainly be interested in the commercial distribution of such filtering devices.

The invention claimed is:

1. An acoustic signal supply circuit of at least one loudspeaker, said circuit comprising a filtering device of a resonance peak occurring at a given frequency of a supply current of said at least one loudspeaker and at least two non-inverting converters arranged in series upstream of said at least one loudspeaker, each of the two converters having a positive supply terminal and a negative supply terminal and an output, the most upstream of the two converters having its positive supply terminal connected to the circuit input supply while its output is connected via an intermediate circuit to the positive supply terminal of the second converter, the output of the second converter being connected to said at least one loudspeaker, characterized in that the filtering device of the resonance peak of said at least one loudspeaker is incorporated in a first branch bypassing the intermediate circuit between said at least two converters, this filtering device being purely electrical and being an impedance connected, firstly, to a point in the intermediate circuit and, secondly, to a ground instrumentation, the impedance being called RLC for comprising at least one first resistor, at least one first capacitor and at least one first inductor arranged in series, a plurality of parameters of the first resistor, the first capacitor and the first inductor being predetermined as a function of the resonance peak to be filtered of said at least one loudspeaker;

wherein the first inductor is virtual in being formed of two non-inverting auxiliary converters arranged in series, each of the two auxiliary converters having a positive supply terminal and a negative supply terminal and an output, the most upstream of the two auxiliary converters having its positive supply terminal connected to the output of the first capacitor whereas the output of this most upstream auxiliary converter is connected by a first auxiliary intermediate circuit to the positive supply terminal of the second auxiliary converter, the first intermediate auxiliary circuit comprising an auxiliary capacitor and being connected in bypass to a first auxiliary instrumentation ground circuit having a first auxiliary resistor, the output of the second auxiliary converter being connected to the first auxiliary converter by a second auxiliary circuit including a second auxiliary resistor, each auxiliary converter having its own feedback loop connecting its output to its negative supply terminal;

wherein a second capacitor is arranged in a second branch bypassing the intermediate circuit between said at least two converters, this second capacitor being associated with a second resistor, the parameters of the second resistor and the second capacitor being predetermined to reduce the high frequency signals;

wherein the intermediate circuit between the two non-inverting converters comprises a third resistor arranged between the output of the most upstream non-inverting converter and the first bypass branch of the intermediate circuit incorporating the filtering device.

2. The circuit of claim 1, wherein the first virtual inductor is equal to the product of the first and second auxiliary resistors and the auxiliary capacitor.

3. The circuit of claim 2, wherein the first resistor and the second auxiliary resistor are deducted from each other in a total resistance according to the equation:

$$R_3=R_{03}-R_A.$$

4. The circuit of claim 1, wherein for a 197 Hz resonance peak frequency, the value of said at least one first resistor is equal to 0, the values of said at least one first capacitor and said at least one first inductor are respectively equal to 0.29 pF and 2.28 H, the values of the first auxiliary resistor and the second auxiliary resistor being respectively equal to 1,200Ω and 400Ω, the value of the third resistor being 3,000Ω.

5. The circuit of claim 1, wherein each non-inverting converter has its own feedback loop connecting its output to its negative supply terminal, each of the feedback loops being mounted, for the most upstream converter, bypassing the intermediate circuit between the two non-inverting converters and, for the most downstream converter, bypassing an instrumentation ground circuit arranged after said at least one loudspeaker, the instrumentation ground circuit comprising a fourth resistor.

6. A method of supply control of the acoustic signal power supply of at least one loudspeaker, the power supply incorporating a filtering device of the resonance peak according to claim 1, in which method a correction step of the resonance peak is performed by the filtering device, this step taking place upstream of said at least one loudspeaker.

7. The method of claim 6, wherein the overall resonance factor of the loudspeaker and of the filtering device is set to a Butterworth filter.

8. The method of claim 6, wherein, when said at least one loudspeaker includes a diaphragm, filtering of the resonance peak is performed simultaneously to a reduction in the sound level in the highest frequencies in the direction of the perpendicular axis of the diaphragm of said at least one loudspeaker.

9. The method of claim 6, wherein temperature variations of said at least one loudspeaker are taken into account by the filtering device by variation matching the impedance parameters of said device.

* * * * *